US011338970B2

(12) United States Patent
Dunwoody

(10) Patent No.: US 11,338,970 B2
(45) Date of Patent: May 24, 2022

(54) CLOSURE ASSEMBLY

(71) Applicant: Crown Packaging Technology, Inc., Alsip, IL (US)

(72) Inventor: Paul Robert Dunwoody, Wantage (GB)

(73) Assignee: Crown Packaging Technology, Inc., Alsip, IL (US)

( * ) Notice: Subject to any disclaimer, the term of this patent is extended or adjusted under 35 U.S.C. 154(b) by 294 days.

(21) Appl. No.: 16/384,132

(22) Filed: Apr. 15, 2019

(65) Prior Publication Data

US 2019/0241332 A1 Aug. 8, 2019

Related U.S. Application Data

(60) Division of application No. 14/972,802, filed on Dec. 17, 2015, now abandoned, which is a continuation of application No. 13/375,090, filed as application No. PCT/EP2010/057086 on May 24, 2010, now abandoned.

(51) Int. Cl.
*B65D 51/14* (2006.01)
*B65D 41/04* (2006.01)

(52) U.S. Cl.
CPC ..... *B65D 51/145* (2013.01); *B65D 41/0442* (2013.01); *B65D 41/0457* (2013.01); *B65D 2543/0024* (2013.01); *Y10T 29/49826* (2015.01)

(58) Field of Classification Search
CPC ..... B65D 51/145; B65D 41/0442; B65D 41/0457; B65D 2543/0024
USPC ..... 220/780, 319, 794, 790
See application file for complete search history.

(56) References Cited

U.S. PATENT DOCUMENTS

| | | | | |
|---|---|---|---|---|
| 2,004,852 A * | 6/1935 | Coyle | B65D 43/0212 220/794 |
| 3,466,381 A | 9/1969 | Boehmke | |
| 3,836,033 A | 9/1974 | Podesta | |
| 4,337,874 A * | 7/1982 | Hoenig | B65D 43/0212 220/783 |
| 4,473,163 A | 9/1984 | Geiger | |
| 4,705,183 A | 11/1987 | Moloney | |
| 5,443,853 A | 8/1995 | Hayes | |

(Continued)

FOREIGN PATENT DOCUMENTS

| | | |
|---|---|---|
| AR | 071646 | 7/2010 |
| CN | 1872632 A | 12/2006 |

(Continued)

*Primary Examiner* — J. Gregory Pickett
*Assistant Examiner* — Niki M Eloshway
(74) *Attorney, Agent, or Firm* — Condo Roccia Koptiw LLP

(57) ABSTRACT

A closure assembly comprising a two-part closure having a metal panel or disc (2) and a ring (3), and a container such as a glass jar (20). The ring (3) is substantially cylindrical with an axially upwardly extending sidewall and has a radially inwardly extending lower edge. The jar (20) terminates in a radially outwardly extending beaded rim (16) and the disc (2) has a curled circumference (8) such that this curl (8) co-operates with the beaded rim (16) of the container to provide a primary seal. In one example, in a metal ring (3), the lower edge is curled with equally spaced lugs (13) on the skirt wall. In a plastic ring, the upper rim feature may be omitted.

9 Claims, 12 Drawing Sheets

(56) References Cited

U.S. PATENT DOCUMENTS

| | | | | |
|---|---|---|---|---|
| 6,276,543 | B1 * | 8/2001 | German | B65D 41/3409 215/252 |
| 2003/0127419 | A1 * | 7/2003 | Shenkar | B65D 51/145 215/256 |
| 2003/0150833 | A1 * | 8/2003 | Shenkar | B65D 51/145 215/252 |
| 2004/0016758 | A1 | 1/2004 | Richardson | |
| 2007/0108155 | A1 | 5/2007 | German et al. | |
| 2008/0073310 | A1 * | 3/2008 | Horton | B65D 51/145 215/276 |
| 2009/0152271 | A1 * | 6/2009 | Kuzelka | B65D 45/345 220/319 |
| 2010/0003109 | A1 * | 1/2010 | Ramsey | B21D 51/44 413/8 |
| 2010/0288769 | A1 * | 11/2010 | Cheng | B65D 43/0202 220/259.4 |
| 2011/0011866 | A1 * | 1/2011 | Dunwoody | B65D 41/02 220/310.1 |
| 2012/0074157 | A1 * | 3/2012 | Dunwoody | B65D 51/145 220/780 |
| 2016/0318686 | A1 * | 11/2016 | Russell | B65D 1/0246 |
| 2019/0344941 | A1 * | 11/2019 | Santini | B65D 43/0231 |

FOREIGN PATENT DOCUMENTS

| | | | |
|---|---|---|---|
| EP | 1686070 | A | 8/2006 |
| EP | 1918041 | | 5/2008 |
| GB | 2441327 | | 3/2008 |
| WO | WO 99/26855 | A1 | 6/1999 |
| WO | WO 2008/053014 | A1 | 5/2008 |
| WO | WO 2009/115377 | A1 | 9/2009 |

* cited by examiner

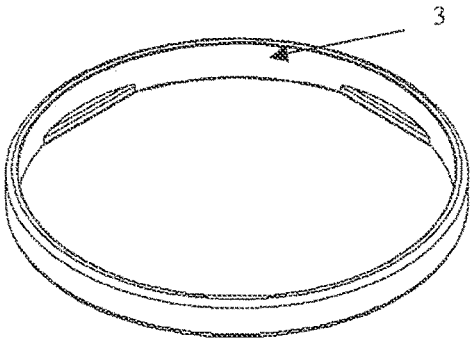
Fig. 17a
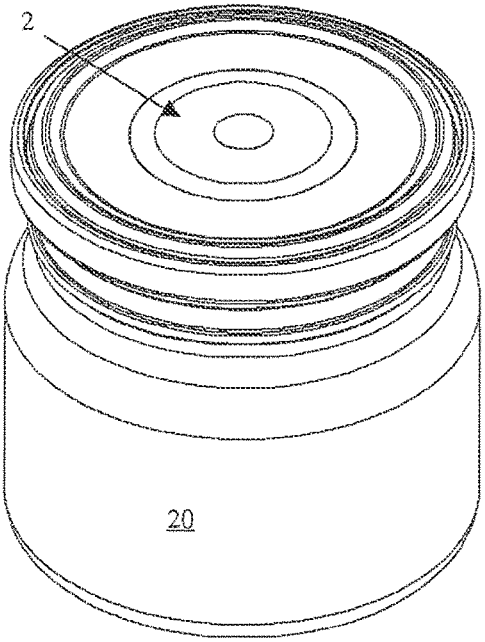
Fig. 17b
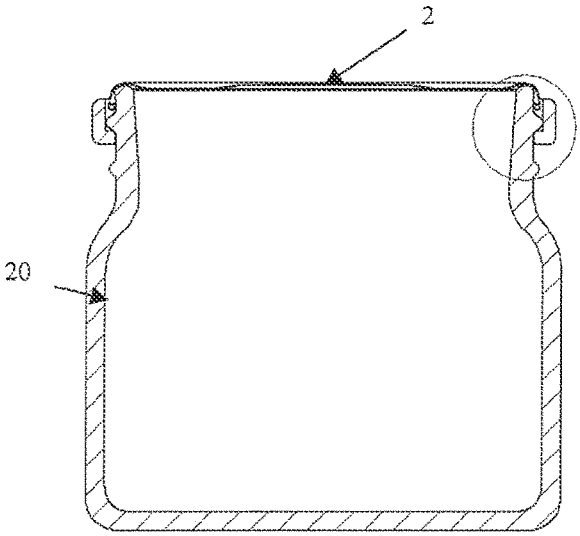
Fig. 17c
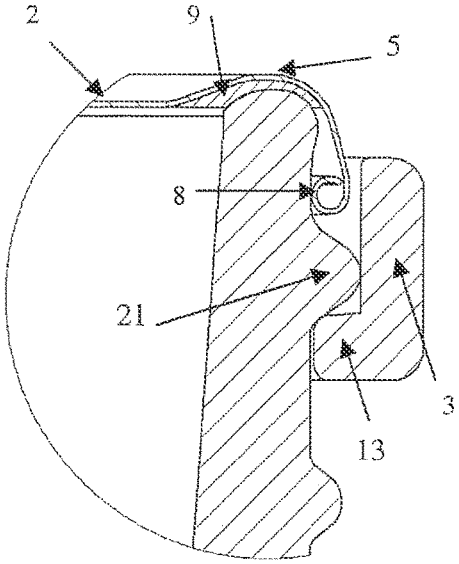
Fig. 17d
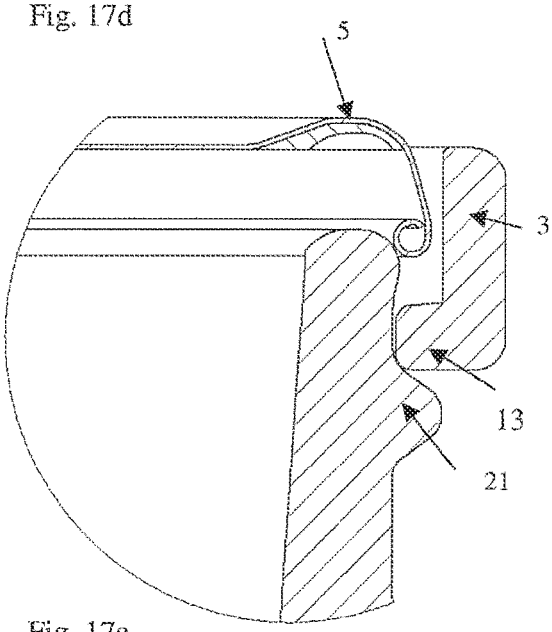
Fig. 17e
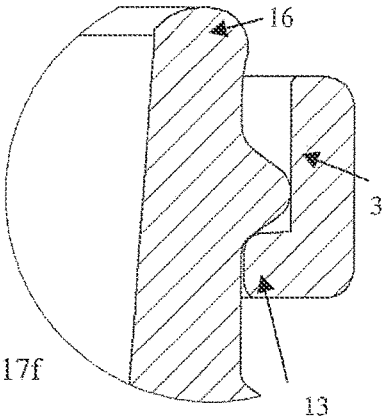
Fig. 17f
Figure 17

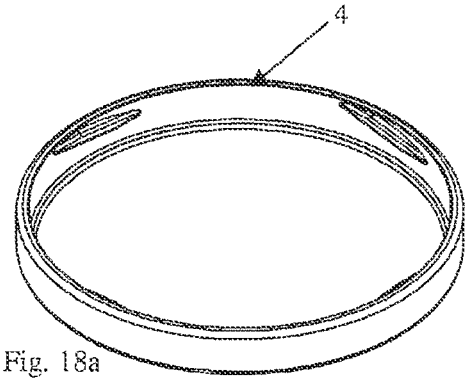
Fig. 18a
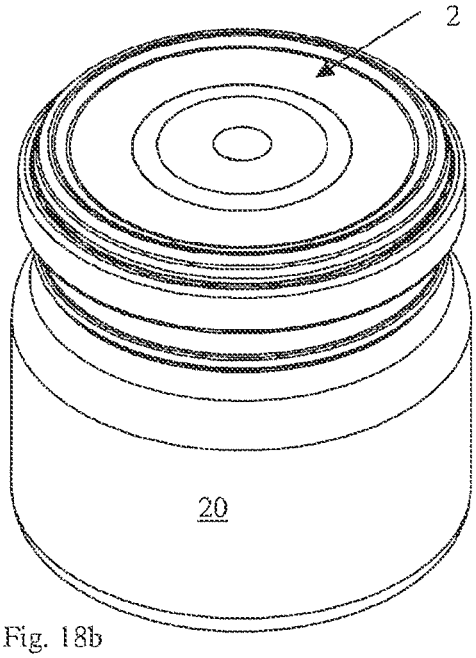
Fig. 18b
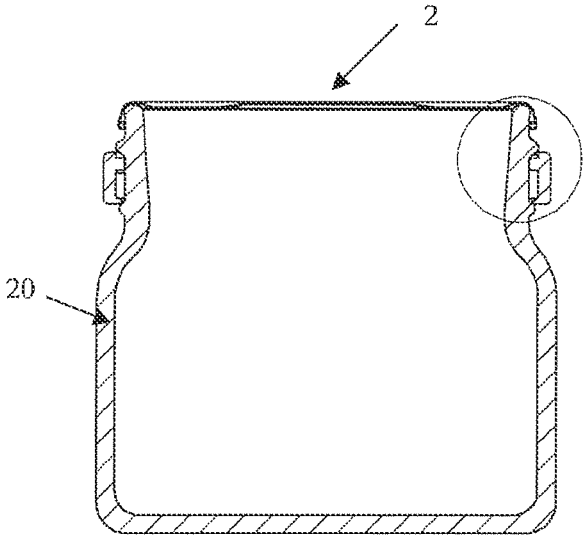
Fig. 18c
Figure 18
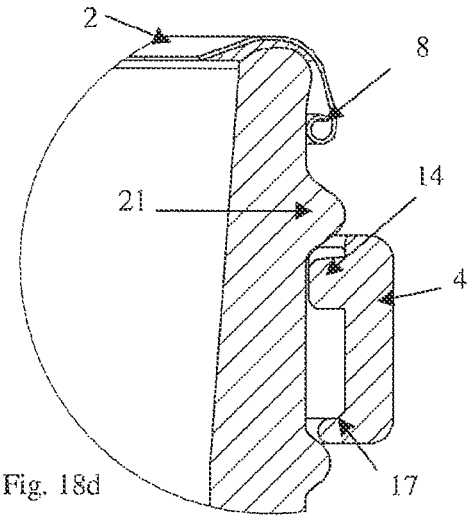
Fig. 18d
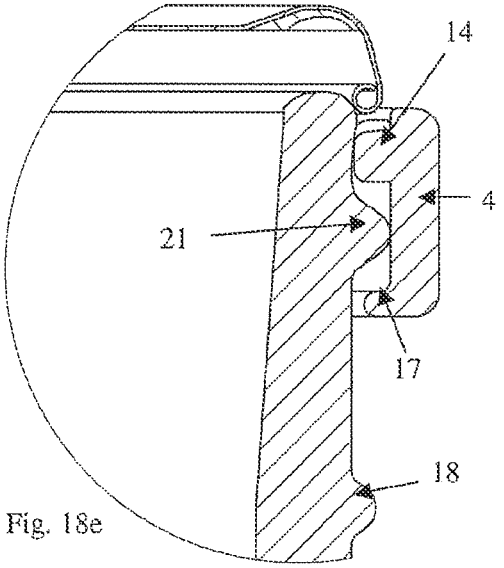
Fig. 18e
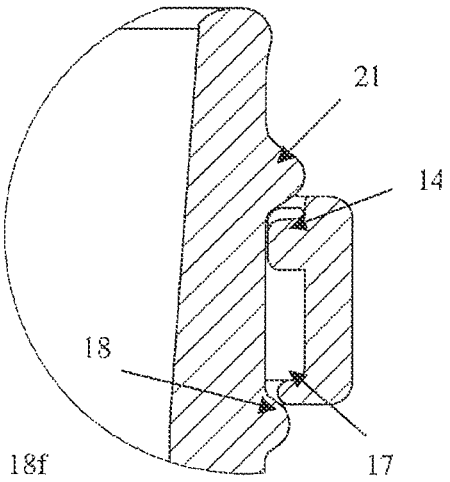
Fig. 18f

CLOSURE ASSEMBLY

CROSS-REFERENCE TO RELATED APPLICATIONS

This application is a divisional of U.S. application Ser. No. 14/972,802, filed on Dec. 17, 2015, which is a continuation of U.S. application Ser. No. 13/375,090, filed Nov. 29, 2011, which is the National Stage of International Application No. PCT/EP2010/057086, filed May 24, 2010, which claims the benefit of GB application number 0909189.3, filed May 29, 2009, the disclosures of which are incorporated herein by reference in their entirety.

TECHNICAL FIELD

This invention relates to a closure assembly and also to a closure for use in such an assembly. The closure assembly comprises a container, which usually includes an engagement feature such as threads, and a closure. The closure is a two-part type of closure, which comprises an inner cap or disc part, and a ring or skirt part.

Typically the closure is used with a container for packaging food stuffs such as pickles, tomato based products, fruit juice or baby food. Such a closure is often referred to as a lid or cap and engages or disengages with the container for closing or opening respectively. In one aspect the invention also relates to a sub-assembly of the threaded container and the ring part of the closure.

BACKGROUND ART

Known two-part closures comprise a cap or disc which is held onto a container by a skirt, which is sometimes referred to as a ring, or by an overcap. The two parts may be of the same material, or different materials as in a combination closure or "combo-cap" which uses a metal disc and a plastic skirt. The skirt often defines threads or lugs, which cooperate with complementary features on a container neck. Sealing material is conventionally applied to the disc to form a seal between the disc and the mouth of the container.

There are many examples of two-part closures, of which U.S. Pat. No. 3,466,381 A (PODESTA ET AL) is one of the older examples. That patent describes a two-part metallic cap with a separate disc and "sleeve-like" skirt. Another two-piece metallic cap from the same inventor is shown in U.S. Pat. No. 3,836,033 A (PODESTA). The metallic disc in that patent moves between concave and convex configurations. Both of these closures can be used for containers such as glass bottles, pots and the like.

It has also been popular to provide screw threads or lugs on the skirt, whether this is of metal or of plastics material. For example, the skirt may be part of a threaded outer cap, as in U.S. Pat. No. 4,473,163 B (ERNST) in which the outer cap prises the inner cap off the container during unscrewing. This is particularly useful when the closure is used for the packaging of food products, which during processing "pull" a negative pressure, often called a "vacuum". This vacuum creates a substantial resistance to opening. The two-piece cap of EP 1686070 A (PLATO PRODUCT CONSULTANTS V.O.F.) has a special feature to reduce torque on opening. This feature is similar to a dimple, which during opening, pushes up a disc-shaped inner cap to overcome the forces between jar and closure, which create the sealing of the package.

The 2-piece closure design allows the breaking of the container seal to be controlled. The initial twisting of the skirt is sometimes used to activate a tamper-evident feature, such as breaking a tamper-evident band, whilst the disc remains sealed to the container. Thereafter, a further feature may be provided on the skirt to prise the disc from the container, thereby breaking the seal between the disc and the container to equalise any difference between the internal pressure in the container and the external environment. This 2-stage opening reduces the torque required to open the closure and allows the closure to be removed more easily.

Although known features such as those described above can reduce the force necessary to break vacuum, there are still problems inherent in the combined opening force requirements of unscrewing and breaking the vacuum. This invention seeks to overcome those problems.

DISCLOSURE OF INVENTION

According to the present invention, there is provided a two-part closure having a metal panel or disc and a ring or "skirt" and being adapted for use with a container (20), in which: the ring or skirt comprises a radially inwardly extending pry-off feature on a substantially cylindrical sidewall; and the metal panel or disc comprises a centre panel, a shoulder and a feature, which is typically a snap-fit feature, for engaging with the rim of the container to form a seal.

The ring part of a closure of this type of assembly may be applied to the container before the container is closed using the panel part. Likewise, it may not be necessary to remove the ring completely or with the panel in order to open the container and remove its contents.

Preferably, the pry-off feature comprises continuous or discontinuous circumferential beads or lugs, which may also be arranged to engage with helical features on the sidewall of the container for rotating of the ring on the sidewall.

The pry-off feature on the closure ring or skirt may be adapted to release the metal panel or disc by breaking the seal between the panel feature and the container edge.

The feature on the panel may comprise a radially inwardly curled edge, which co-operates with the rim of the container as a snap-fit feature. The curled edge is preferably in the range of 0.4-1.0 mm radius. The alternative term to panel which is used herein, i.e. "disc", is used to define the whole of an inner cap component and is not intended to infer that that component is simply a thin circular component. The disc may be profiled for sealing a container to which the closure is attached.

Preferably, the container includes a bead and the panel's curled edge, in use, fits over the bead. The container bead assists retention of the panel part. The curled edge of the panel may be an inward or an outward curl, and may include undulations and/or pleats.

The container may be a jar or bottle (of glass or plastics material) or even a metal can, and although a usual use for the closure of the invention would be with a glass jar used for packaging foodstuffs, the expressions are used interchangeably in this application.

The two parts of the closure may be provided separately, and the ring or skirt part assembled to the container as a sub-assembly. Clearly when the ring is pre-assembled to the container, it must be profiled such that the panel can close the container in a separate subsequent operation. For this sub-assembly, the ring does not have an inwardly projecting rim.

An advantage of the ring of the present invention is that there is no need to rotate any part of the closure or jar during capping, provided that the ring is positioned with its lugs below the jar thread. Simpler and more reliable high-speed capping than that of conventional twist closures can thus be achieved. The ring may also be easily removed from the jar after use to assist recycling.

Another alternative ring may be provided that has an inwardly projecting lower rim. This lower rim may be used to retain the ring on the jar, which is especially useful if the ring is to be applied to the jar before it is filled and closed using the panel part. The shape and flexibility of the ring is adjustable to allow the ring to be removed from the jar to assist recycling.

This ring may be made of either metal or plastic material, and the outer surfaces may be knurled or shaped to assist grip by consumers for ease of opening. The use of this type of ring also permits the consumer to more easily re-close the container by simply pushing the panel down onto the jar, without need for twisting.

In a further aspect of the invention, which provides a method of attaching the ring to the container or jar, filling the container/jar and closing the container/jar with the panel, the method could involve providing the sub-assembly to the filler who would then fill the container/jar and add the panel prior to processing.

The sidewall of the ring may extend axially and vertically beyond the disc whereby, in use, the disc is protected.

The pry-off feature may be situated at a distance from the top edge of the ring and, most importantly, spaced from the snap-fit feature of the disc when, in use, the closure is in its closed position on a container.

In a preferred embodiment, the metal panel comprises DR (double reduced tinplate or ECCS in the range of 500-600 $Nmm^{-2}$ and thickness ranging between 0.13 mm and 0.2 mm. The material is normally selected to provide suitable panel strength when subjected to pressure and vacuum during and after food processing. When the ring is of metal, the ranges may be the same as for the panels.

BRIEF DESCRIPTION OF FIGURES IN THE DRAWINGS

Preferred embodiments of the invention will now be described, by way of example only, with reference to the drawings, in which.

Figure 2:
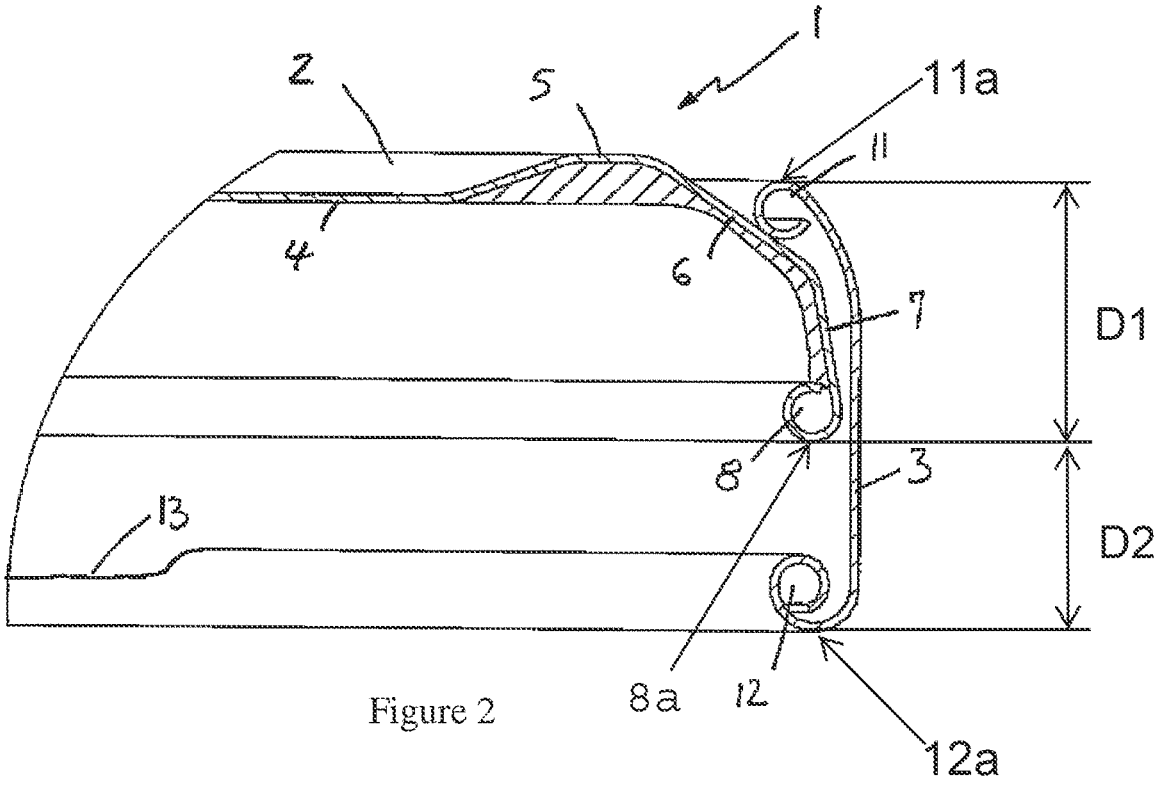
FIG. 2 is a partial side section through a curl of a closure with plain wall.
Figure 3:
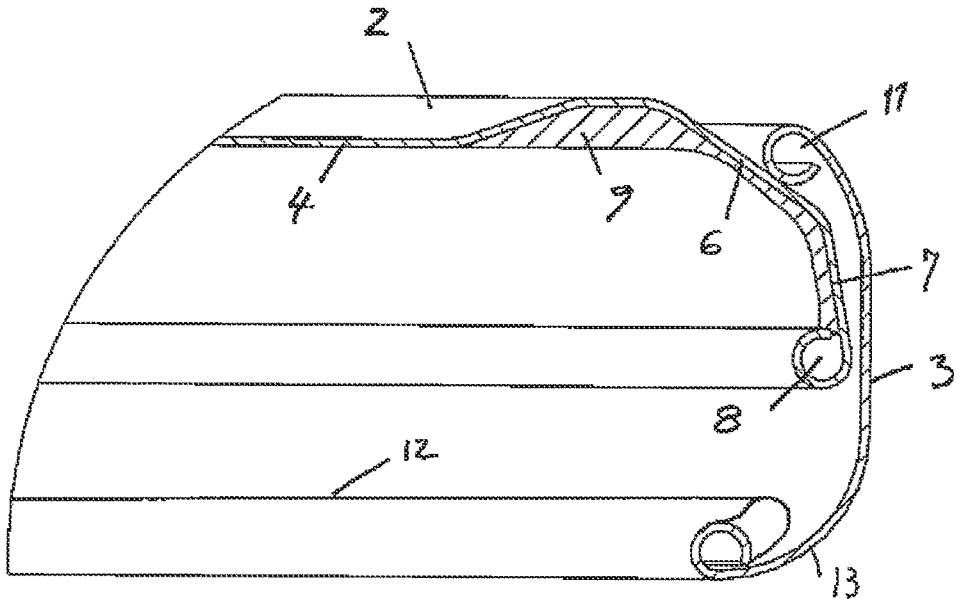
FIG. 3 is a partial side section through a lug of the closure of FIG. 2.
Figure 10:
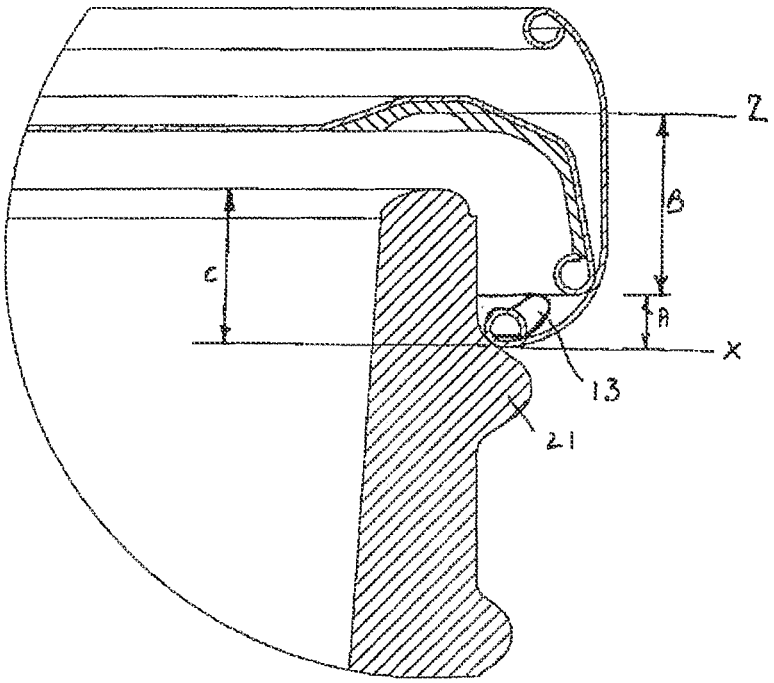
Figure 11:
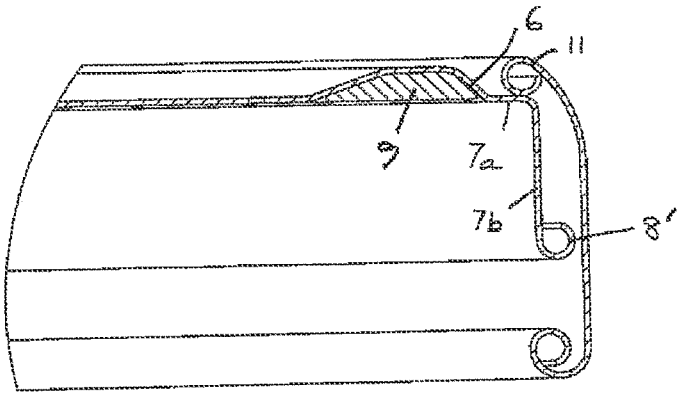
Figure 12:
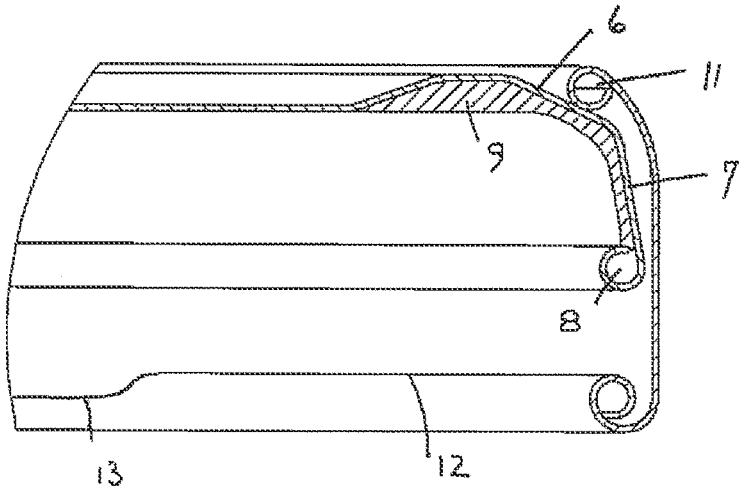
Figure 13:
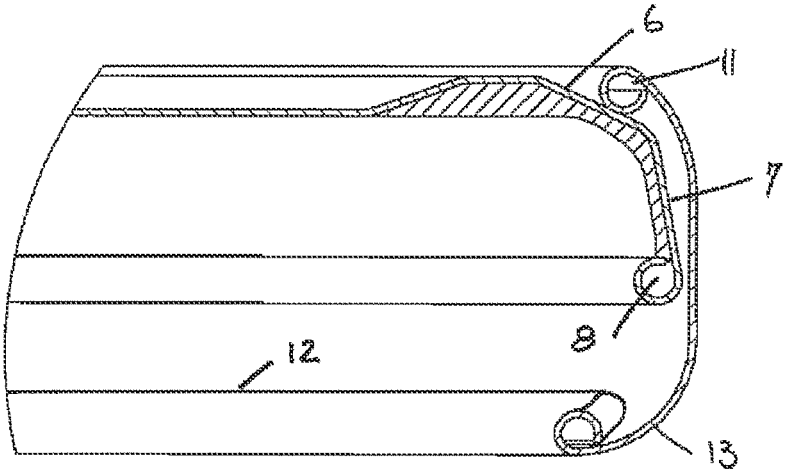
Figure 14A:
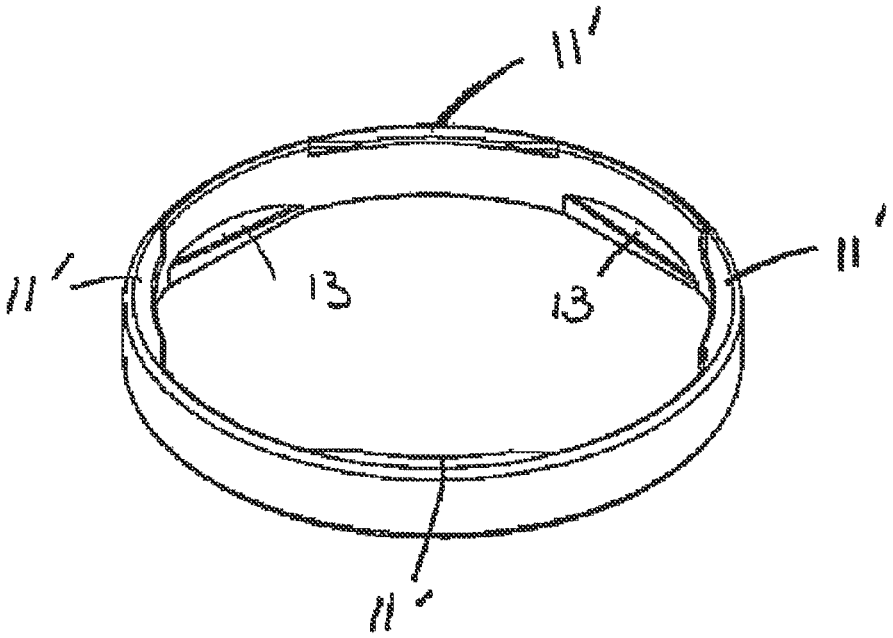
Figure 14B:
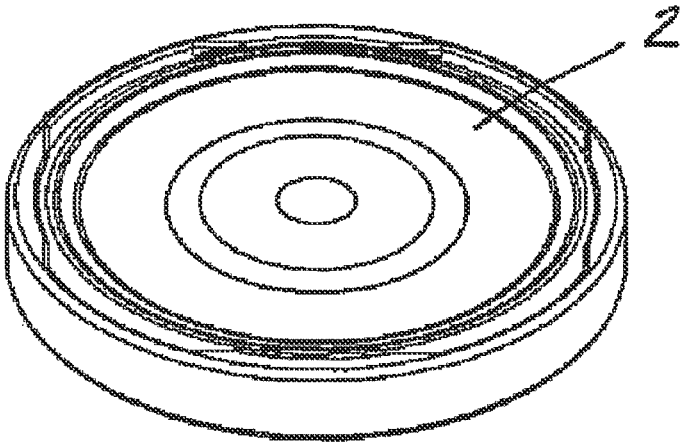
Figure 15:
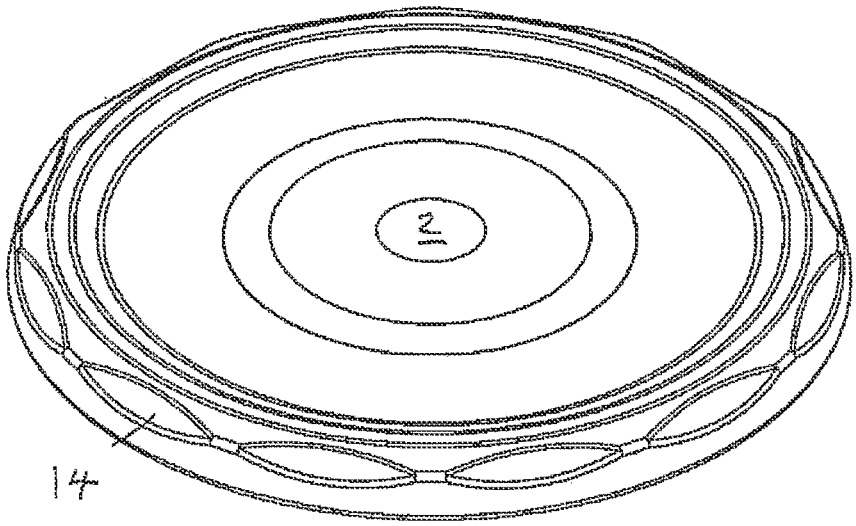
Figure 16:
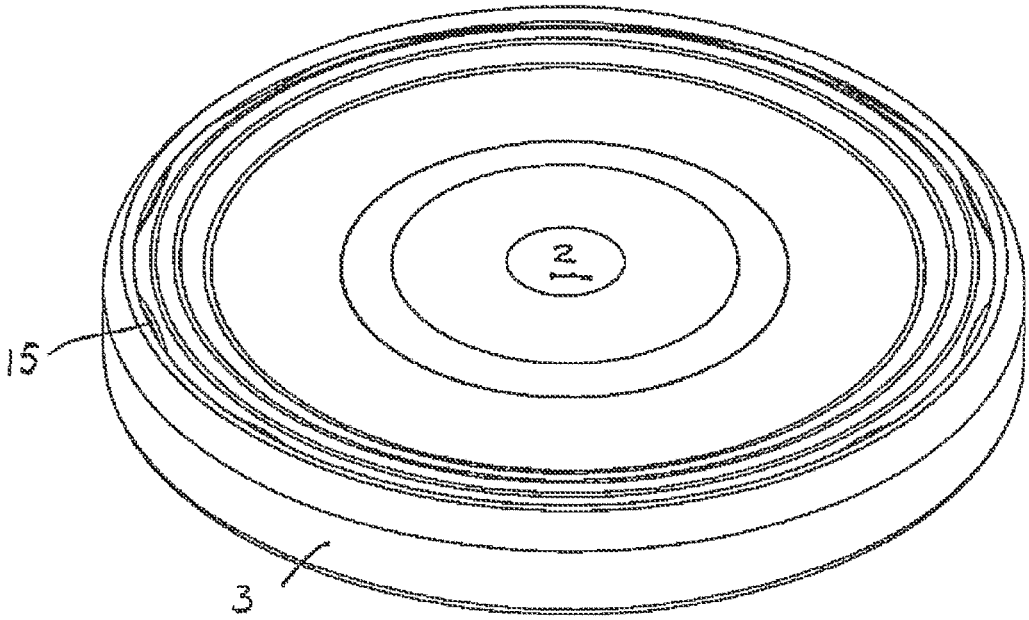

FIG. 10 a partial side section through a lug of the closure of FIGS. 2 and 3, above a jar after opening;

FIG. 11 is a partial side section through a curl of a closure with an outward curl on the disc;

FIG. 12 is a partial side section through a curl of a closure, with the top of the ring above the disc;

FIG. 13 is a partial side section through a lug of the closure of FIG. 12;

FIGS. 14*a* and 14*b* are perspective views of a closure ring and closure with four inwardly projecting rim portions opposite gaps between lugs;

FIG. 15 is a perspective view of a disc having flats;

FIG. 16 is a perspective view of the disc of FIG. 15, fitted in a ring.

Figure 19:
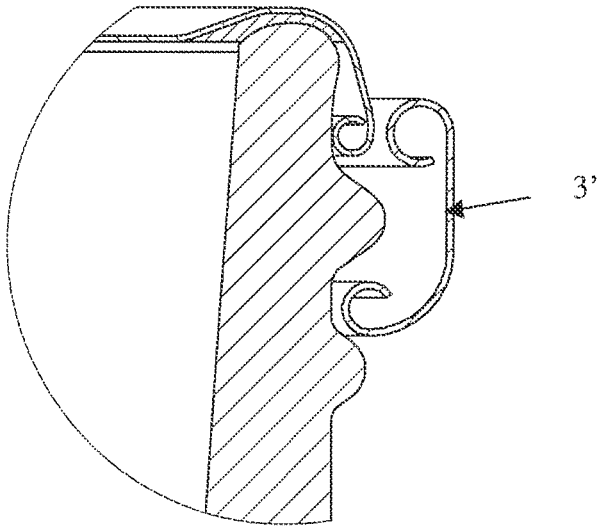
Figure 20:
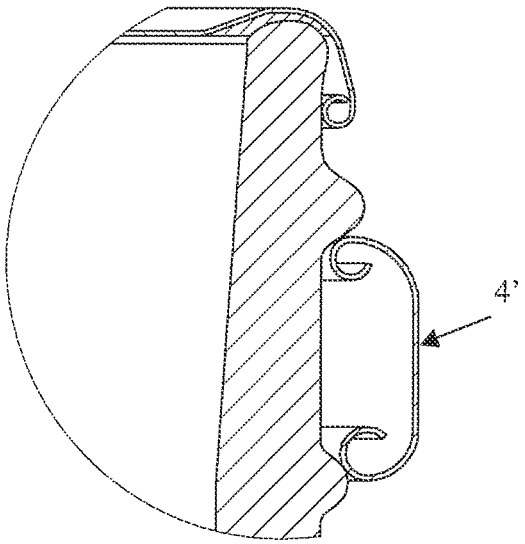

FIGS. 17 *a* to *f* are views of an alternative ring and a closed jar and sectional views of a jar and closure with the ring;

FIGS. 18 *a* to *f* are views of a further alternative ring and a closed jar and sectional views of a jar and closure with the ring;

FIG. 19 is a cross section similar to that of FIG. 17 with a ring made of metal; and FIG. 20 is a cross section similar to that of FIG. 18 with a ring made of metal.

MODE(S) FOR CARRYING OUT THE INVENTION

Figure 1A:
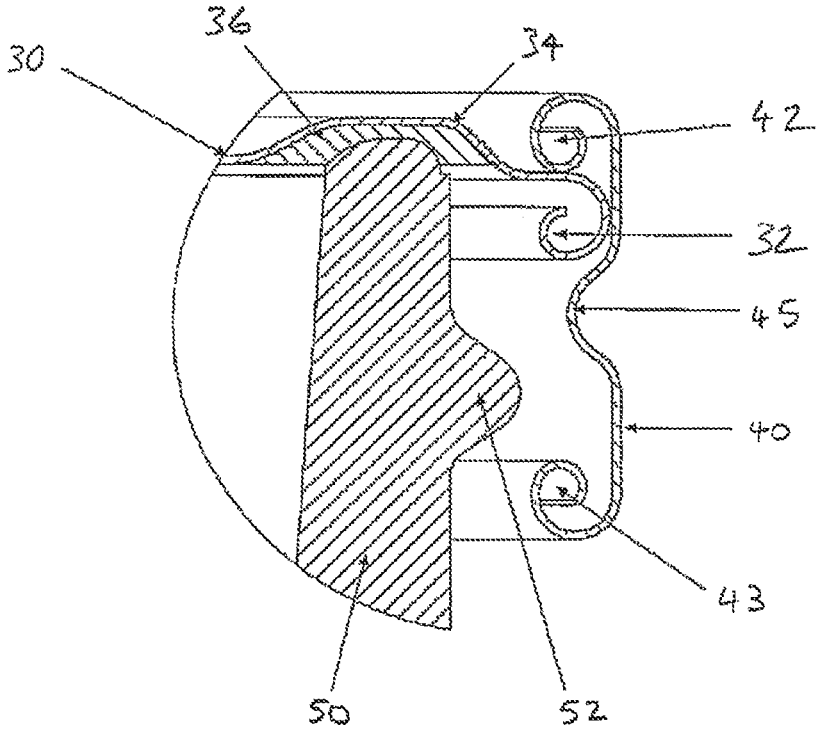
Figure 1a Prior Art
FIGS. 1A and 1B are partial side sections of an all-metal closure with an annular projection on the wall of its skirt.
Figure 1B:
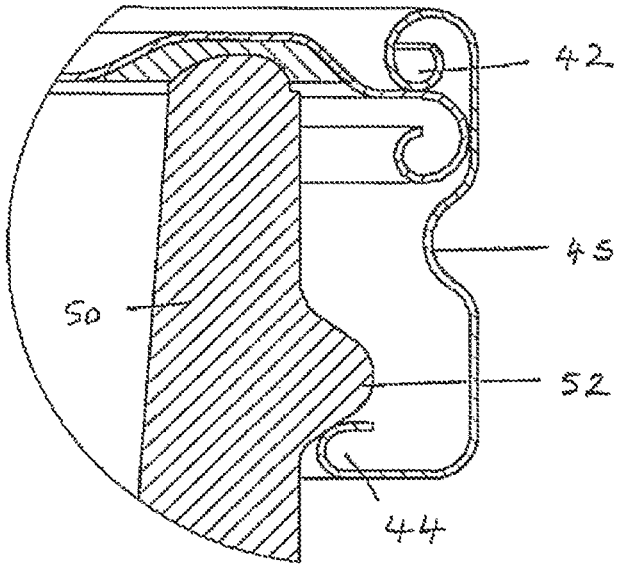
Figure 1b Prior Art

FIGS. 1A and 1B are side sections of a two-part closure manufactured for example in accordance with unpublished patent application PCT/EP2007/061744. Alternatively, the ring could be manufactured separately by techniques such as welding (e.g. laser welding), extrusion, or by using tubing. This of course means that the ring is not necessarily formed from metal. The closure comprises a metal disc 30, having its cut edge protected by a curl 32, and a circumferential ring 40. The disc 30 is trapped within the ring 40 by two curls 42, 43 at the opposed axial ends of the ring. FIG. 1A is a section through a curl 43 and FIG. 1B is a section through a lug 44.

A retention feature, or features 45 is/are provided to position the disc 30 loosely within the ring 40, whilst allowing the disc 30 freedom to move rotationally relative to the ring 40 and limiting axial movement. The retention feature 45 may take the form of spaced projections around the circumference of the ring 40, or alternatively may be provided by a circumferential bead, either full or segmented. A channel 34 is provided about the inside periphery of the disc 30 and this channel is used to hold sealing material 36. The provision of the channel 34 ensures proper location of the sealing material to interface with the neck of a container 50 and also reduces the quantity of sealing material 36 because of its better and more accurate distribution. A portion of thread 52 is also shown in FIGS. 1A and 1B. For opening, unscrewing of the closure causes lugs 44 to move over threads 52, causing retention feature 45 to push upwards against disc curl 32, thereby raising the disc 30 from the container 50.

FIGS. 2 and 3 show an all-metal two-part closure 1 having a disc part 2 and a skirt or ring part 3. Disc 2 has a central panel 4, surrounded by upwardly extending groove 5, shoulder 6, annulus 7 and terminating in inward curl 8. The groove 5 is profiled so as to retain sealing material or material 9, in this example from the edge of central panel 4 to the curl 8.

The skirt 3 of FIGS. 2 and 3 has inward curls 11 and 12 at both upper and lower ends and lugs 13 (typically four, equi-spaced) around the lower edge. The lugs 13 are shown most clearly in the underplan view of FIG. 4. The top of the skirt (ring) in FIGS. 2 and 3 is below the level of the top of the channel 5, so that this embodiment is sometimes referred to as "ring below disc" or "disc over ring".

This ring below disc configuration has a smooth feel. When the closure is used to close a filled container, there is less risk of scuffing of the ring. An alternative ring below disc closure may have the disc panel extending outside the top curl of the ring.

When the container is a glass jar which is closed by the ring below disc closure, it is well suited for stacking. The top of the closure may nest with a stacking bead around the bottom rim of the jar above.

In its form independently of any container, the disc 2 is free to move between a lower position when the curl on the disc abuts curl 12 and/or lug 13, and an upper position, as shown, when the disc abuts curl 11. The shoulder 6 of the disc of FIGS. 2 and 3 contacts upper curl 11. Sealing material 9 could of course be contained more locally by shaping the disc.

Figure 5:
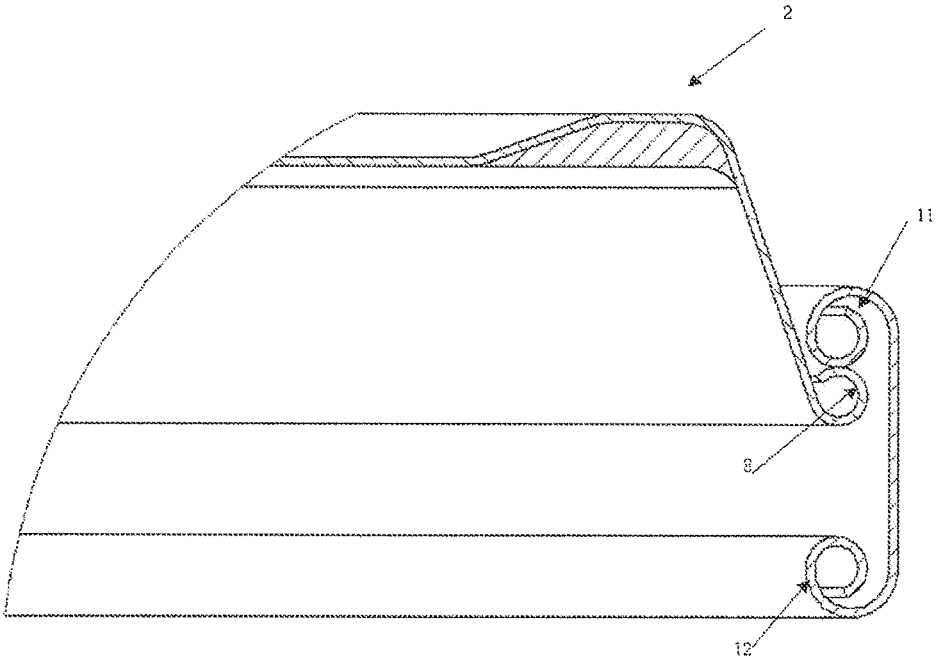
FIG. 5 is a partial side section through a curl of an alternative closure with an outward disc curl.
Figure 6:
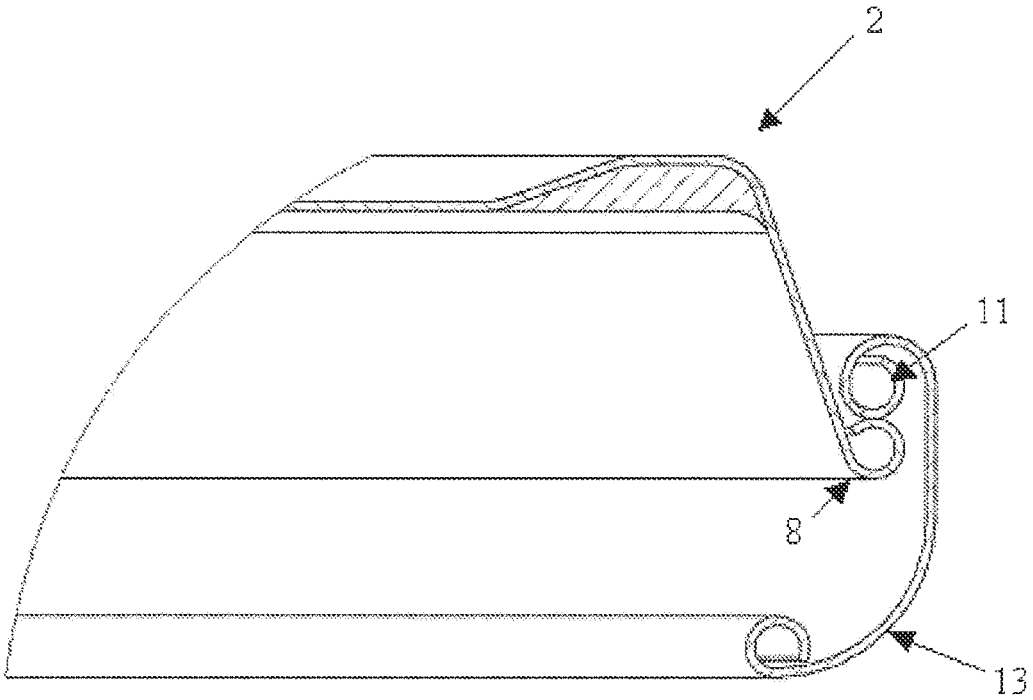
FIG. 6 is the partial side section of FIG. 5 through a lug of the closure.

Either curl may be inward or outward (reversed), with the ring above or below the panel. The curls may be partly or fully closed, rest on or in features of the disc 2 or ring 3, or other possible variants. In one arrangement, as shown in FIGS. 5 and 6, the disc curl 8 may be outward and the top curl 11 may be inward, such that the surface of the ring curl 11 that was originally on one side (preferably the decorated side) of the metal sheet contacts the surface of the disc curl 8 that was originally on the other side of the metal sheet. In this arrangement the contacting surfaces may have different coatings or one may not be coated at all, in order to avoid similar coatings sticking to one another, and the possibly undecorated surface of the outside of the disc curl 8 may be hidden from view when looking from the outside of the closure. FIG. 5 shows the inward top curl 11 resting on the outward disc curl 8 at a section through the lower curl 12 and FIG. 6 shows the same closure at a section through the lower lug 13.

Many features of the closures become more clear when closures are used to close a container. Although any screw container could be closed by any closure according to the invention, the drawings of FIGS. 7 to 10 show a glass jar, which has very distinct threads.

Figure 7:
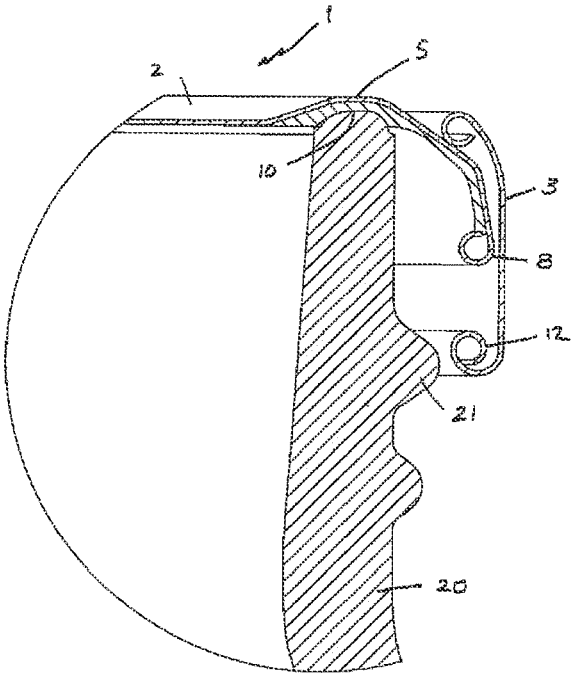
FIG. 7 is a partial side section through the curl of the closure of FIGS. 2 and 3 in closed position on a jar.
Figure 8:
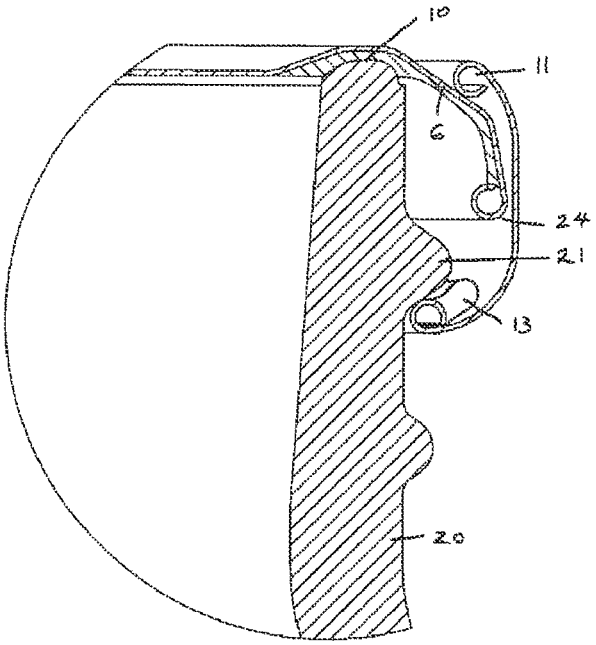
FIG. 8 is a partial side section through a lug of the closure of FIGS. 2 and 3 in closed position on a jar.

FIGS. 7 and 8 show the closure of FIGS. 2 and 3, closing a glass jar 20. When the closure is applied to a glass jar, the top of the jar presses into sealing material 9 forming an imprint and improved seal 10. The skirt (ring) is rotated and the lug 13 is moved under the thread 21 to pull the disc down.

The relative positions of improved seal 10, underside of disc rim 24 and inwardly projecting lug 13 can be seen in FIG. 8. The seal is defined by that part of the sealing material 9 imprinted by the jar 20.

In the closed position of FIGS. 7 and 8, shoulder 6 presses against upper curl 11 on the skirt, and lugs 13 press against the underside of threads 21. In the closed position of FIG. 8, the lug is under the thread of the glass jar, effectively pulling the disc into place and squeezing the sealing material.

Figure 9:
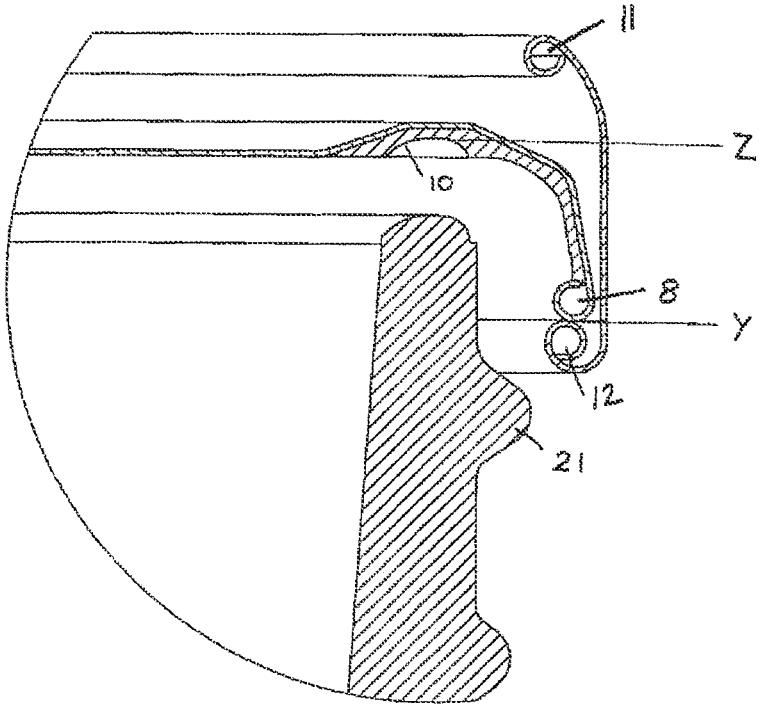
FIG. 9 is a partial side section through the curl of the closure of FIGS. 2 and 3, above a jar after opening.

Counter-rotation of the ring causes the lugs to move to positions above the adjacent threads and application of further torque causes lifting of the disc and full opening of the closure (see FIGS. 9 and 10). In the open position, the user has rotated the ring such that the lug 13 is now resting on top of the thread portion 21 (FIG. 10) and the adjacent portion of the bottom curl 12 has moved to contact the bottom of the disc curl 8 (FIG. 9). Moving the curls into contact with each other raises the disc, thereby breaking the seal.

In the final position of FIG. 10, a lug 13 contacts screw thread 21 at position 'X'. In FIG. 9, the contact point of curls 8 and 12 is shown as 'Y'. The effective lug thickness, which is the axial distance between X and Y, is distance 'A'. The axial (vertical) distance from the uppermost part 'Z' of compressed material (seal 10) to the bottom of disc curl 8 is 'B'. The distance from the glass finish (top of the container) to the top of thread 21 is 'C'.

In order for the seal to be broken, it is necessary for the sum of distances A+B to be greater than distance C.

An alternative version as shown in FIG. 11 has an outward curl 8'. FIG. 11 also shows how the sealing material 9 may be contained more locally by shaping the disc 2 into two parts: an upper annulus or horizontal portion 7*a* adjacent the shoulder 6 and a depending or vertical portion 7*b*, which terminates in an outward curl 8'. This is, of course an option which may be used in any of the other embodiments of the invention.

FIG. 11 shows the ring above the level of the top of groove 5 as it is in a "ring over disc" closure.

The embodiment of FIGS. 12 and 13, which is also of the "ring over disc" type, has a disc with inward curl 8, inclined shoulder 6 and single part annulus 7. The "ring over disc" closures have uppermost part of disc 3 lower than the top of the skirt, which may assist tightening of the skirt during closing. Over-tightening of the container may be avoided by flexing of the skirt in combination with the disc and at most the skirt will become level with the disc.

It is conventional to provide curls where an exposed edge of cut metal might otherwise be dangerous during handling, to obscure edges for cosmetic purposes, or to protect against corrosion.

Although the embodiments of closure shown in FIGS. 2 to 13 have all metal forms, it is clearly possible to have a metal disc and a plastic skirt. This enables the form shown in FIGS. 14*a* and 14*b* to be made more easily, although it could still be made from metal. FIG. 14*a* shows the skirt 3' alone. The top projection 11' is in four parts, with lugs 13 positioned below gaps between projections 11'. If the skirt 3' is made from plastic, the ejection of the skirt from the mould is easier, as is insertion of the metal disc 2 into the more flexible skirt.

Other features, which the closure may include, are flats or similar undulations 14 around the disc which form gaps 15 when inserted in skirt 3 (FIGS. 15 and 16). This provides a ventilation path and drying of the spaces between the skirt, disc and container is improved after filling.

The closure assembly of FIG. 17 is shown in a schematic manner only but is intended to include many of the options of FIGS. 2 to 16. The closure disc of FIG. 17 is adapted to cooperate with the container such as a jar for sealing and does not rely on any upper projection of the ring. It is not necessary to insert the disc within the ring before applying the ring to the threaded container. In fact the ring may be applied, for example by screwing onto the container before closing and may remain on the container even after it has served its function of lifting the disc for opening.

Figure 4:
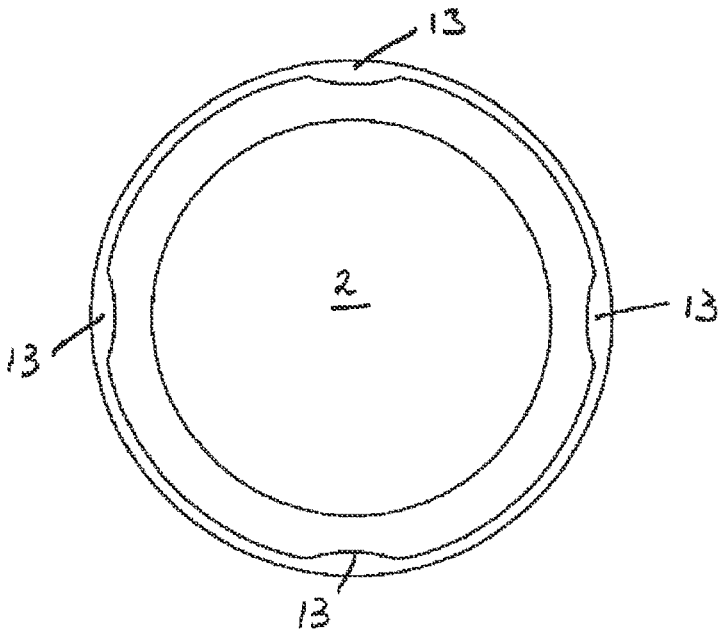
FIG. 4 is an underplan view showing four lugs.

Thus, FIG. 17*a* shows a ring 3 of plastics material but similar to the plan view of FIG. 4, which has no inwardly projecting upper rim. FIG. 17*b* shows an assembly of the ring of FIG. 17*a* with a panel 2 and a jar 20. The upper rim of ring 3 extends substantially vertically without any axial contact, and no or minimal radial, contact with the disc shoulder. This has the effect that the closure assembly can include features of either the "ring over disc" or "ring below disc" types of the earlier embodiments. The choice of ring sidewall height depends purely on whether it is more important to prevent damage or dislodging of the disc or panel 2, in which case the ring 3 will extend axially beyond the disc position, or to avoid scuffing of the ring, in which case the ring sidewall will be lower than the disc 2.

The panel or disc 2 is of metal and has a snap-fit feature such as a curled edge 8 as shown in the sections of FIGS. 17*d* and 17*e*. As before, the disc is not simply a thin circular component but includes a profile 5 suitable for containing sealing compound 9 if desired for sealing a container such as glass jar 20. The jar 20 includes a beaded edge 16 over which the curl of the disc/panel 2 may fit ("snap fit") to assist retention of the panel to the jar when closed. For optimum retention, the curl 8 is curled radially inwardly as shown and the curl is at least 360° so as to avoid corrosion of the exposed cut edge of the metal. An outward curl could still function in the same way but would require further shaping so as to tuck under the bead 21. Of course, this curled edge may include undulations and/or pleats 14 as shown in FIG. 15, which may provide flexibility and assist retention of the panel over the bead. Alternatively, the features 14 can remain outside the sealing surface outside diameter so that sealing is not compromised.

The groove or annulus 5 in the metal disc forms a channel, which is profiled for optimum retention of sealing compound 9 as is also shown in FIGS. 2 and 3. In the embodiment of FIG. 17, the material 9 for sealing may be at least partially pre-formed so as to contact around the sealing surface at the top of the jar. This pre-forming is also of assistance where the sealing is either only obtained by holding under retention bead 16 at the top of the jar, or by whatever additional negative pressure arises when food contents within the jar 20 are processed and "pull" a vacuum. In the absence of any ring feature to pull the disc down further onto the jar, it can be useful for an imprint already to be made in the sealing compound by mechanical means during application of the disc to the jar. What is essential to the embodiment of FIG. 17 is that the disc 2 cooperates with the jar rather than with the ring for primary sealing.

FIG. 17*c* shows a cross-section of the assembly of FIG. 17*b* in a closed position, and FIGS. 17*d* and 17*e* are detailed views of the cross-section in closed and opened positions respectively. In the closed position of FIG. 17*d*, projection 13 is below and engaged with screw thread 21. In the open position of FIG. 17*e*, projection 13 is on top of the thread 21, positioned for "prying-off" (lifting) the disc by contact with curl 8. The ring 3 of FIG. 17 is of plastics material and is shown in a very schematic manner with a simple cylindrical sidewall or skirt and inward projection 13 at its lower end.

Whilst FIG. 17*d* shows the projection 13 of the ring in a preferred position below the thread of the closed jar, it is not necessary for the projection to be positioned below the thread because the retaining bead 16 and/or the vacuum within the jar may be sufficient to hold the panel 2. The projections or lugs serve the function of lifting the disc 2 from the jar by axial contact with the edge of disc 2 as the ring is moved axially, for example by unscrewing.

As noted above, it is possible firstly to assemble the ring to the jar as is shown for example in FIG. 17*f*. In this embodiment, the jar has an additional portion of increased diameter 18 to secure and limit the lowermost position of the ring by screwing the ring downwards until the lugs contact portion 18. The portion of increased diameter may be a bead as shown in FIG. 17 or may more simply be a shoulder on the jar. With the ring already assembled to the jar it is possible to simplify the closing of the jar, by simply pushing the panel downwards. This also provides the pre-forming of the sealing compound, if necessary.

The embodiment of FIG. 17 thus includes many of the features of the earlier figures but functions by co-operation of the disc with the jar, for closing, and with the ring, for opening.

As the ring may be of metal or plastics material, a wide range of possibilities present themselves for projection 13. For example, the projection 13 may be inwardly projecting lugs as in the metal ring of FIGS. 6 and 8. Alternatively, the projections can be moulded as in the plastic ring of FIG. 14.

It is also possible for there to be projections both in the form of lugs and also further projections positioned further "up" the sidewall of the skirt as shown in FIG. 18. The latter projections 14 act as the pry-off feature(s) whereas the lug-type of projections 17 allow rotation of the ring up a helical profile on the container sidewall.

The pry-off feature 14 is positioned below the snap-feature of the metal panel and, in use, lug-style projections 17 can serve not only to engage with helical features on the container sidewall but also to pry-off the disc by release of the snap-fit seal.

FIG. 18*a* shows a ring that has an inwardly projecting lower rim 17, and FIG. 18*b* is an assembly of that ring with a panel and a jar. FIG. 18*c* shows a cross-section of the assembly of FIG. 18*b* in a closed position, and FIGS. 18*d* and 18*e* are detailed views of the cross-section in closed and opened positions respectively. As in FIG. 17, the jar has a bead 16 over which the curl on the panel fits to assist retention of the panel to the jar when closed.

In FIG. 18, the jar has an additional portion of increased diameter (here shown as bead 18) which secures and limits the lowermost position of the ring, by screwing the ring downwards until the lower rim 17 contacts the additional portion 18. The bead as shown in FIG. 18 could alternatively and more simply be a shoulder on the container.

Whilst FIG. 18*d* shows the lug of the ring below the thread of the closed jar, it is not necessary for the lug to be positioned below the thread if the panel is held by the retaining bead and/or the vacuum within the jar. It is also possible firstly to assemble the ring to the jar as is shown in FIG. 18*f*, by flexing the ring and pushing the lower rim 17 over the jar threads. With the ring already assembled to the jar, closing of the jar can be simplified, by simply pushing the panel downwards.

FIGS. 19 and 20 show enlarged cross sections of a top part of a closed jar in which the ring of FIG. 17*d* has been replaced by a ring 3' made of thin sheet metal and where the ring of FIG. 18*d* has been replaced by a ring 4' made of thin sheet metal, respectively.

Although the invention has predominantly been described with reference to an all-metal closure and a glass jar, the scope of the invention is also intended to include changes and modifications to materials etc and numbers of features such as lugs, as defined by the scope of the claims.

The invention claimed is:

1. A container and two-part closure combination, the combination comprising:

- a container having a neck about which a screw thread is disposed; and
- a two-part closure, the two-part closure comprising:
  - a disc having a center panel, a shoulder disposed about the center panel, and a feature extending from the shoulder, the feature configured to engage with the neck of the container in a snap-fit relationship; and
  - a ring disposed about the disc, the ring having a projection that extends radially inwardly, the projection having a bottom surface and a top surface opposite the bottom surface, the bottom surface configured to engage the screw thread and the top surface configured to engage the feature so as to release the disc from the neck of the container.

2. The container and two-part closure combination of claim 1, wherein the feature is a skirt that depends downwardly from the shoulder, the skirt including a curl at its bottom end.

3. The container and two-part closure combination of claim 2, wherein the container neck defines an open top end and the container neck has a bead that extends radially outwardly from the open top end, the bead defining a first diameter, and wherein the feature has an inner surface that defines a second diameter that is less than a first diameter.

4. The container and two-part closure combination of claim 2, wherein the projection extends from a bottom portion of the ring.

5. The container and two-part closure combination of claim 4, wherein the ring further having an upper portion extending upwardly from the bottom portion about the disc, wherein the upper portion is spaced away from the disc.

6. The container and two-part closure combination of claim 2, wherein the projection is a first projection that extends from a top portion of the ring and the ring further includes a second projection that extends from a bottom portion of the ring.

7. The container and two-part closure combination of claim 2, wherein the projection is discontinuous about a circumference of the disc.

8. The container and two-part closure combination of claim 2, wherein the curl is curled radially inwardly.

9. The container and two-part closure combination of claim 2, wherein the disc is metal and the ring is plastic.

* * * * *